US009638057B2

(12) United States Patent
Kwon

(10) Patent No.: US 9,638,057 B2
(45) Date of Patent: May 2, 2017

(54) AUGMENTED COOLING SYSTEM

(71) Applicant: Rolls-Royce North American Technologies, Inc., Indianapolis, IN (US)

(72) Inventor: Okey Kwon, Indianapolis, IN (US)

(73) Assignee: Rolls-Royce North American Technologies, Inc., Indianapolis, IN (US)

( * ) Notice: Subject to any disclaimer, the term of this patent is extended or adjusted under 35 U.S.C. 154(b) by 615 days.

(21) Appl. No.: 14/145,655

(22) Filed: Dec. 31, 2013

(65) Prior Publication Data

US 2015/0016947 A1 Jan. 15, 2015

Related U.S. Application Data

(60) Provisional application No. 61/781,257, filed on Mar. 14, 2013.

(51) Int. Cl.
*F01D 5/18* (2006.01)
*F01D 25/12* (2006.01)
*F01D 25/26* (2006.01)

(52) U.S. Cl.
CPC ..... *F01D 25/12* (2013.01); *F01D 5/186* (2013.01); *F01D 5/187* (2013.01); *F01D 25/26* (2013.01);
(Continued)

(58) Field of Classification Search
CPC ..... F05D 2240/126; F05D 2240/127; F05D 2260/2212; F05D 2260/2214; F05D 2260/22141; F23R 2900/03045
See application file for complete search history.

(56) References Cited

U.S. PATENT DOCUMENTS 529,823 A 11/1894 Wiens
3,584,972 A 6/1971 Bratkovich et al.
(Continued)

FOREIGN PATENT DOCUMENTS

EP 742347 A2 11/1996
EP 1533481 A2 5/2005
(Continued)

OTHER PUBLICATIONS

International Search Report for PCT International Application Serial No. PCT/US2014/010048, completed Apr. 17, 2014, (13 pages).

*Primary Examiner* — Gregory Anderson
*Assistant Examiner* — Christopher R Legendre
(74) *Attorney, Agent, or Firm* — Barnes & Thornburg, LLP

(57) ABSTRACT

An apparatus and method for cooling a dual, walled component is disclosed herein. An augmented cooling system according to the present disclosure includes transporting a cooling fluid through one wall of a cooling pathway formed between two opposing spaced apart walls of the dual walled component. The cooling fluid can be deflected away from one wall of the cooling pathway with a first trip strip as the cooling fluid traverses along the cooling pathway. The cooling fluid can be deflected away from the opposing wall of the cooling pathway with a second trip strip as the cooling fluid continues traversing along the cooling pathway. The cooling fluid can then be discharged from the cooling pathway through the opposing wall of the dual walled component.

13 Claims, 5 Drawing Sheets

(52) U.S. Cl.
CPC .... *F05D 2230/21* (2013.01); *F05D 2230/232* (2013.01); *F05D 2240/126* (2013.01); *F05D 2240/127* (2013.01); *F05D 2260/202* (2013.01); *F05D 2260/204* (2013.01); *F05D 2260/2212* (2013.01); *F05D 2260/2214* (2013.01); *F05D 2260/22141* (2013.01)

(56) References Cited

U.S. PATENT DOCUMENTS 3,616,125 A * 10/1971 Bowling ..... F01D 5/184 277/345
4,184,326 A 1/1980 Pane, Jr. et al.
4,221,539 A 9/1980 Corrigan
4,269,032 A 5/1981 Meginnis et al.
4,270,883 A 6/1981 Corrigan
4,296,606 A 10/1981 Reider
4,302,940 A 12/1981 Meginnis
4,312,186 A 1/1982 Reider
4,347,037 A 8/1982 Corrigan
4,359,310 A 11/1982 Endres et al.
4,407,632 A 10/1983 Liang
4,422,300 A 12/1983 Dierberger et al.
4,642,993 A 2/1987 Sweet
4,944,152 A 7/1990 Shekleton
5,127,221 A 7/1992 Beebe
5,223,320 A 6/1993 Richardson
5,328,331 A 7/1994 Bunker et al.
5,383,766 A 1/1995 Przirembel et al.
5,667,359 A 9/1997 Huber et al.
5,690,472 A 11/1997 Lee
5,702,232 A 12/1997 Moore
5,931,638 A 8/1999 Krause et al.
6,098,397 A 8/2000 Glezer et al.
6,122,917 A 9/2000 Senior
6,145,319 A 11/2000 Burns et al.
6,205,789 B1 3/2001 Patterson et al.
6,213,714 B1 4/2001 Rhodes
6,224,339 B1 5/2001 Rhodes et al.
6,237,344 B1 5/2001 Lee et al.
6,265,409 B1 7/2001 Cheshire et al.
6,282,905 B1 9/2001 Sato et al.
6,383,602 B1 5/2002 Fric et al.
6,408,628 B1 6/2002 Pidcock et al.
6,408,629 B1 6/2002 Harris et al.
6,427,466 B1 8/2002 Livni
6,484,505 B1 11/2002 Brown et al.
6,513,331 B1 2/2003 Brown et al.
6,640,546 B2 11/2003 Lee et al.
6,651,662 B2 11/2003 Prete et al.
6,655,146 B2 12/2003 Kutter et al.
6,655,149 B2 12/2003 Farmer et al.
6,681,578 B1 1/2004 Bunker
6,808,367 B1 * 10/2004 Liang ..... F01D 5/187 415/115
7,182,576 B2 * 2/2007 Bunker ..... F01D 5/187 29/889.2
7,544,044 B1 * 6/2009 Liang ..... F01D 5/188 416/96 R
7,690,894 B1 4/2010 Liang
7,775,053 B2 * 8/2010 Joe ..... F01D 5/187 60/805
2001/0016162 A1 8/2001 Lutum et al.
2002/0197161 A1 12/2002 Roeloffs et al.
2003/0068222 A1 4/2003 Cunha et al.
2003/0115882 A1 6/2003 Lee et al.
2003/0167772 A1 9/2003 Farmer et al.
2004/0076519 A1 4/2004 Halfmann et al.
2005/0118023 A1 6/2005 Bunker et al.
2008/0166240 A1 7/2008 Scott et al.
2009/0317234 A1 12/2009 Zausner et al.
2010/0186419 A1 7/2010 Joe et al.
2013/0004332 A1 1/2013 Schnieder et al.
2015/0016947 A1 * 1/2015 Kwon ..... F01D 5/186 415/1

FOREIGN PATENT DOCUMENTS

JP 2012189085 A 10/2012
JP 2012211749 A * 11/2012
WO 9825009 A1 6/1998

* cited by examiner

RIB PATTERN

AUGMENTED COOLING SYSTEM

CROSS REFERENCE TO RELATED APPLICATIONS

This application claims priority to and the benefit U.S. Provisional Patent Application No. 61/781,257, filed on Mar. 14, 2013, the disclosure of which is now expressly incorporated herein by reference.

TECHNICAL FIELD

The present disclosure relates to an augmented cooling system and more particularly, to an augmented cooling system for use in dual wall components operating in high temperature applications such as gas turbine engines and the like.

BACKGROUND

Gas turbine engine designers continuously work to improve engine efficiency, to reduce operating costs of the engine, and to reduce specific exhaust gas emissions such as NOx, CO2, CO, unburned hydrocarbons, and particulate matter. The specific fuel consumption (SFC) of an engine is inversely proportional to the overall thermal efficiency of the engine, thus, as the SFC decreases the fuel efficiency of the engine increases. The thermal efficiency of a turbofan engine is a function of component efficiencies, cycle pressure ratio, and turbine inlet temperature. As temperatures increase in the gas turbine system, augmented cooling of certain components can be required. Gas turbine power systems remain an area of interest for technology improvement. Some existing gas turbine power systems have various shortcomings, drawbacks, and disadvantages relative to certain applications. Accordingly, there remains a need for further contributions in this area of technology.

SUMMARY

One embodiment of the present disclosure is a unique cooling system for high temperature applications. Another embodiment includes a gas turbine engine having an augmented cooling system for cooling certain high temperature components. Other embodiments include unique apparatuses, systems, devices, hardware, methods, and combinations for gas turbine engine power systems. Further embodiments, forms, features, aspects, benefits, and advantages of the present application shall become apparent from the following description and drawings.

BRIEF DESCRIPTION OF THE FIGURES

The description herein makes reference to the accompanying drawings wherein like reference numerals refer to like parts throughout the several views, and wherein.

DETAILED DESCRIPTION OF REPRESENTATIVE EMBODIMENTS

Figure 1:
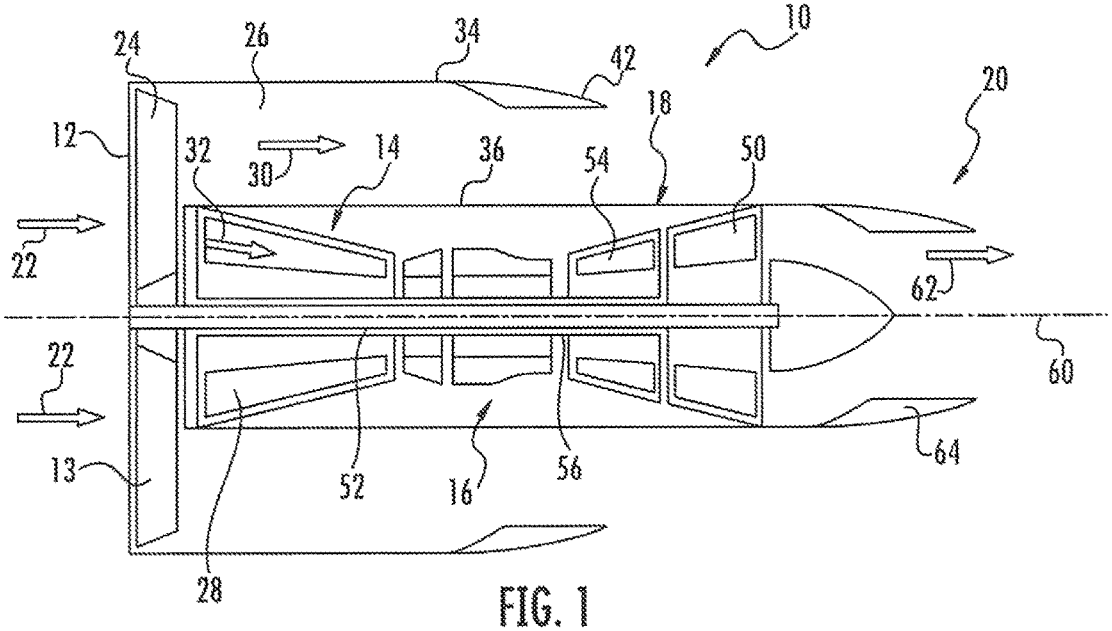
FIG. 1 is a schematic cross-sectional side view of a turbofan engine having cooled dual wall components according to an embodiment of the present disclosure.

For purposes of promoting an understanding of the principles of the invention, reference will now be made to the embodiments illustrated in the drawings, and specific language will be used to describe the same. It will nonetheless be understood that no limitation of the scope of the invention is intended by the illustration and description of certain embodiments of the invention. In addition, any alterations and/or modifications of the illustrated and/or described embodiment(s) are contemplated as being within the scope of the present invention. Further, any other applications of the principles of the invention, as illustrated and/or described herein, as would normally occur to one skilled in the art to which the invention pertains, are contemplated as being within the scope of the present invention.

When the terms "upper and lower" or similar words describing orientation or relative positioning are used in this disclosure, it should be read to apply to the relative location in a particular view and not as an absolute orientation of a particular portion of a dual wall component in operation.

Referring to FIG. 1, a schematic view of a gas turbine engine configured as a turbofan engine 10 is depicted. While the turbofan engine 10 is illustrated in simplistic schematic form, it should be understood that the present disclosure including a novel cooling system is not limited to any particular engine design or configuration and as such may be used with any form of gas turbine engine such as turboprops, turbojets, unducted fan engines, and others having a range of complexities including multiple spools (multiple turbines operationally connected to multiple compressors), variable geometry turbomachinery, and in commercial or military applications. Further the novel cooling system defined by the present disclosure can be used in other systems that operate in hot environments wherein cooling of certain components is required to provide structural and operational integrity.

The turbofan engine 10 will be described generally as one embodiment of the present disclosure, however significant details regarding gas turbine engine design and operation will not be presented herein as it is believed that the theory of operation and general parameters of gas turbine engines are well known to those of ordinary skill in the art. The turbofan engine 10 includes an inlet section 12, a fan section 13, a compressor section 14, a combustor section 16, a turbine section 18, and an exhaust section 20. In operation, air illustrated by arrows 22 is drawn in through the inlet 12 and passes through at least one fan stage 24 of the fan section 13 where the ambient air is compressed to a higher pressure. After passing through the fan section 13, the air can be spot into a plurality of flowstreams. In this exemplary embodiment, the airflow is spilt into a bypass duct 26 and a core passageway 28. Airflow through the bypass duct 26 and the core passageway 28 is illustrated by arrows 30 and 32 respectively. The bypass duct 26 encompasses the core passageway 28 and can be defined by an outer circumferential wall 34 and an inner circumferential wall 36. The bypass duct 26 can also include a bypass nozzle 42 operable for creating a pressure differential across the fan 24 and for accelerating the bypass airflow 30 to provide bypass thrust for the turbofan engine 10.

The core airflow 32 enters the core passageway 28 after passing through the fan section 13. The core airflow is then further compressed in the compressor section 14 to a higher pressure relative to both ambient pressure and the air pressure in the bypass duct 26. The air is mixed with fuel in the combustor section 16 wherein the fuel/air mixture burns and produces a high temperature working fluid from which the turbine section 18 extracts power. The turbine section 18 can include low pressure turbine 50 mechanically coupled to the fan section 13 through a low pressure shaft 52 and a high pressure turbine 54 mechanically coupled to the compressor section 14 through a high pressure shaft 56. The shafts 52, 56 rotate about a centerline axis 60 that extends axially along the longitudinal axis of the engine 10, such that as the turbine section 18 rotates due to the forces generated by the high pressure working fluid, the fan section 13 and compressor section 14 section are rotatingly driven by the turbine section 18 to produce compressed air. After passing through the turbine section 18, the core exhaust flow represented by arrow 62 is accelerated to a high velocity through a core exhaust nozzle 64 to produce thrust for the turbofan engine 10.

Figure 2:
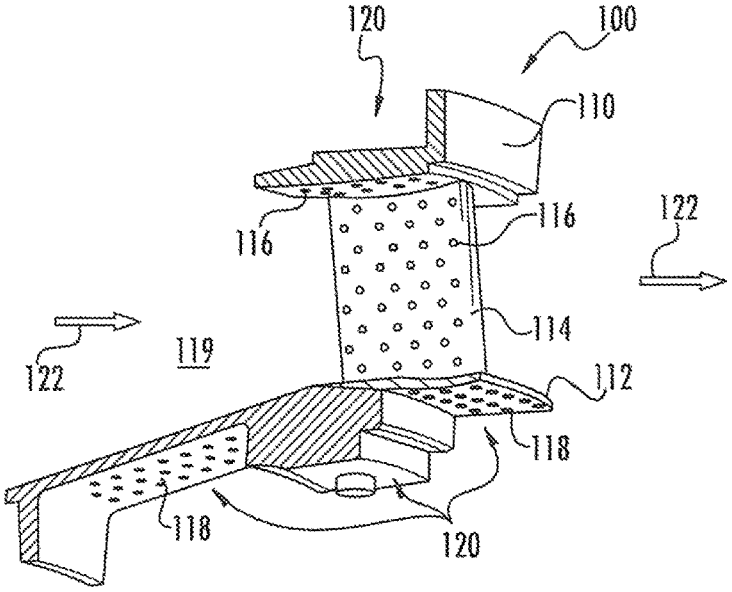
FIG. 2 is a perspective view of a representative dual wall component in the form of a vane segment according to an embodiment of the present disclosure.

Referring now to FIG. 2, a vane segment 100 is illustrated as an exemplary component having a dual wall construction with a cooling fluid flowpath formed therebetween as will be described in detail below. The vane segment 100 can include an outer end wall 110 and an inner end wall 112 proximate a tip and a hub respectively of a vane 114. The end walls 110, 112 can be configured to operably connect with a support structure (not shown) of the engine 10. A plurality of outlet cooling holes 116 can be formed along the outer surface of the vane 114 and the end walls 110, 112 to eject cooling fluid 120 from the vane segment 100 and into a hot fluid flowpath 119. The hot fluid flowpath 119 can be bounded by the outer vane end wall 110 and the inner vane end wall 112. High temperature fluid such as exhaust gas from a combustion section as illustrated by arrow 122 can flow through the hot fluid flowpath 119 and transfer heat into the vane segment 100. Cooling fluid 120, such as air or the like can be provided to the vane segment 100, by way of example and not limitation through an inlet aperture or a plurality of inlet cooling holes 118 formed in one or both of the end walls 110, 112.

Figure 3:
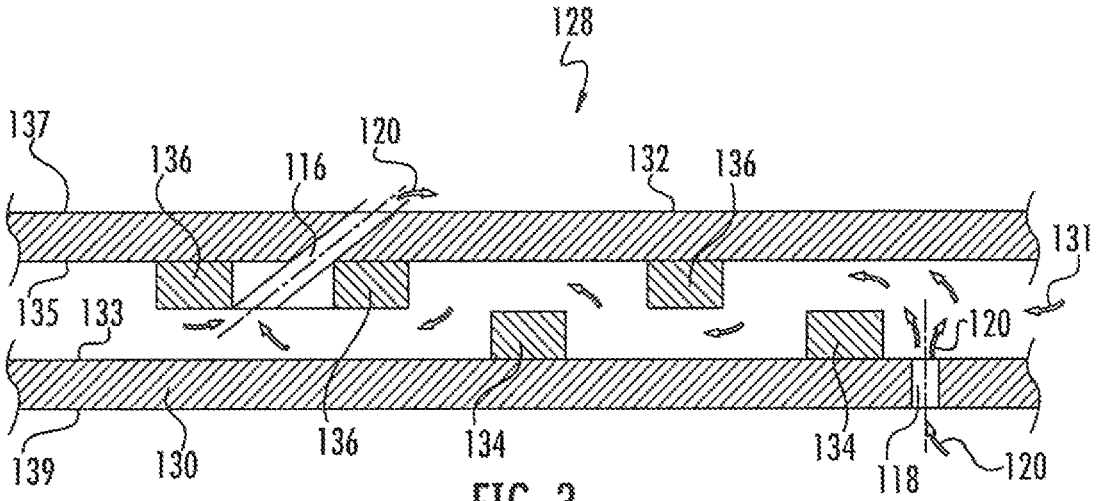
FIG. 3 is a cross-sectional view of a portion of a dual wall component according to an embodiment of the present disclosure.

Referring now to FIG. 3, a portion of a dual wall component 128 illustrating a cooling fluid flowpath 131 formed between an inner wall 130 and an outer wall 132 of the dual wall component 128 is shown in cross-section. The inner wall 130 can be spaced apart from the outer wall 132 at a desired distance to form the cooling fluid flowpath or passageway 131. The inner and outer walls 130, 132 include cooling flowpath surfaces 133 and 135, respectively to form upper and lower boundaries for the cooling fluid flowpath 131. The cooling fluid 120 can flow across the cooling flowpath surfaces 133, 135 and remove heat from the dual wall component 128 though convection heat transfer means. A plurality of inner trip strips 134 can be formed adjacent the cooling flowpath surface 133 of the inner wall 130. A plurality of outer trip strips 136 can be formed adjacent the cooling flowpath surface 135 of the outer wall 132. As can be seen with the arrows in FIG. 3, the cooling fluid 120 can enter an inlet through aperture or hole 118 and flow through the cooling fluid flowpath 131 in multiple directions. The cooling fluid 120 can in alternating fashion pass over an inner trip strip 134 and under an outer trip strip 136 one or more times prior to exiting through an outlet cooling hole 116. In the exemplary embodiment, the inner trip strips 134 are positioned in alternating fashion with outer trip strips 136 such that the cooling fluid 120 passes over an inner trip strip 134 and under an outer trip strip 136 in consecutive order, however it should be understood that other configurations are contemplated by the present disclosure such as placing a series of inner trip strips 134 and/or a series of outer strips 136 in consecutive order along the fluid flowpath 131.

The outer wall 132 of the dual wall segment 128 includes a hot flowpath surface 137 to form a boundary for hot fluid flow 122 (shown in FIG. 2) to pass across. After traversing a series of inner and outer trip strips 134, 136 the cooling fluid 120 can exit the dual wall component 128 through outlet cooling holes 116 and into the hot flowpath 119 (see FIG. 2). The outlet cooling holes 116 can be configured in such a way as to direct the cooling fluid 122 across the outer surface 137 of the outer wall 132. In this manner the cooling fluid 120 can film cool and partially insulate the outer wall 132 from the hot fluid flow 122.

Figure 4:
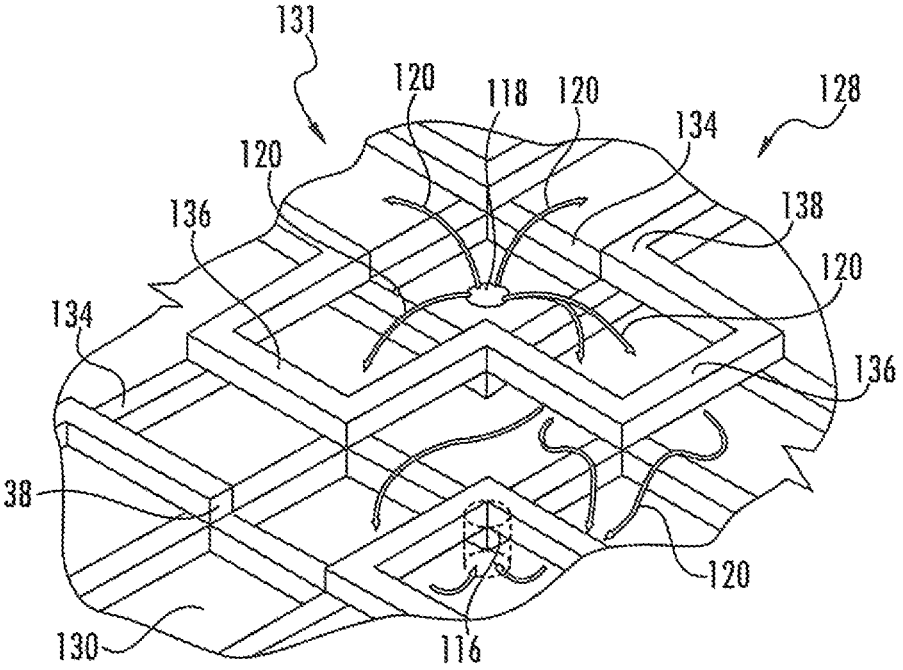
FIG. 4 is a cutaway view of a portion of a dual wall component according to an embodiment of the present disclosure.
Figure 7:
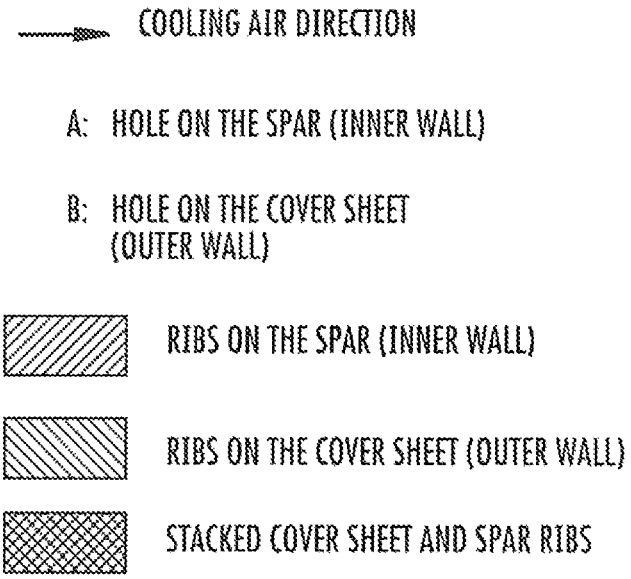
FIG. 7 illustrates patterns formed by trip strips.
Figure 7:
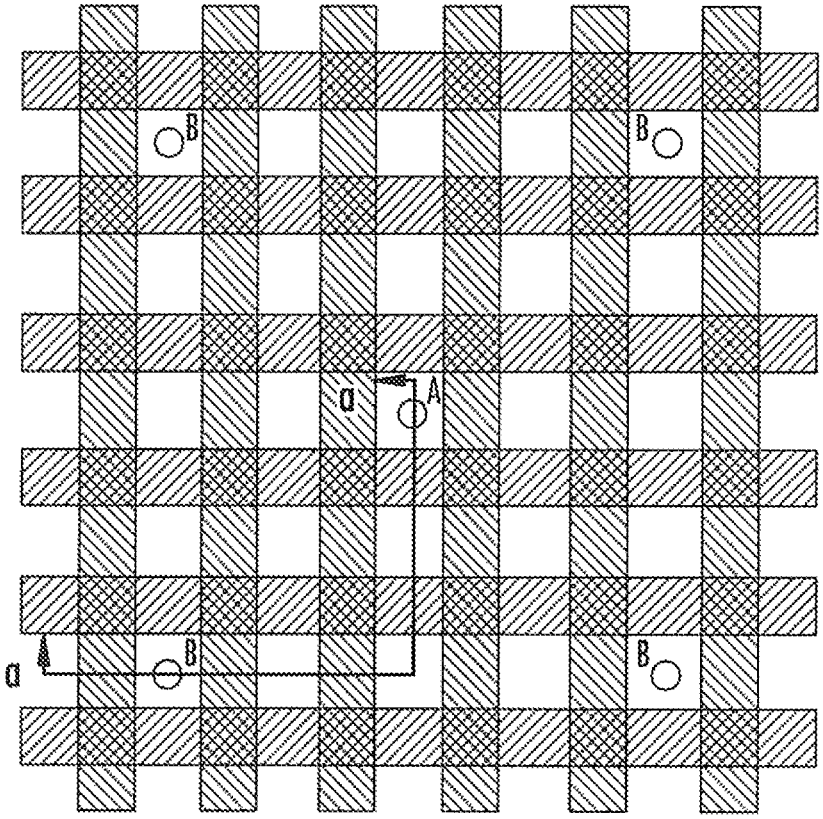

As will be appreciated given various of the embodiments discussed below, the trip strips 134, 136 can intersect each other whereupon the union of the trip strips 134, 136 form a pedestal that extends between the inner wall 130 and outer wall 132. The trip strips 134 and/or 136 can be arranged in a variety of patterns as will be evident in the embodiments described and illustrated below. For example, FIG. 4 shows a closed square formed by trip strips 134 that surround cooling hole 118 on the inner wall 130. Formed on the outer wall 132, trip strips 136 are arranged in a closed Maltese cross pattern that covers the square shape formed by trip strips 134 that surround the cooling hole 118. The Maltese cross pattern formed by the trip strips 136 are located in the upper portion of the figure, where a portion of the Maltese cross is not illustrated for sake of convenience. FIG. 7 illustrates patterns of squares and Maltese crosses formed by trip strips 134, 136 located on both the inner wall 130 and outer wall 132. The pattern can be designed in a symmetric and repeatable pattern throughout the cooling fluid flowpath, but not all embodiments need be symmetric and repeatable. FIG. 7 illustrates that the cooling holes 116 and 118 can be surrounded by trip strips in such a fashion that the trip strips form a recess well in which the cooling holes are located. The recessed well can be formed solely by trip strips, and in some forms can be bounded by a collection of trip strips and pedestals, whether the pedestals are formed by a union of opposing trip strips or have a shape different than a union of opposing trip strips.

Referring now to FIG. 4, a partial perspective cut-away of a portion of the cooling flowpath 131 is shown therein. The cooling fluid illustrated by arrows 120 is shown entering the cooling flowpath 131 through an inlet aperture 118 formed in the inner wall 130. From there, the cooling fluid 120 can disperse in all directions as illustrated by the arrows pointing in a 360° pattern. Each of the various flow streams represented by arrows 120 of the cooling fluid can traverse across inner trip strips 134 and under outer trip strips 136 one or more times prior to exiting out of the outer cooling hole 116. In one exemplary embodiment of the present disclosure, flow streams formed in the cooling flowpath 131 can include passage across several trip strips both inner 134 and outer 136 prior to exiting the dual wall component 128. In another exemplary embodiment, a flowstream may pass across only one inner trip strip 134 and/or only one outer trip strip 136 prior exiting through an outlet cooling hole 116.

Figure 5:
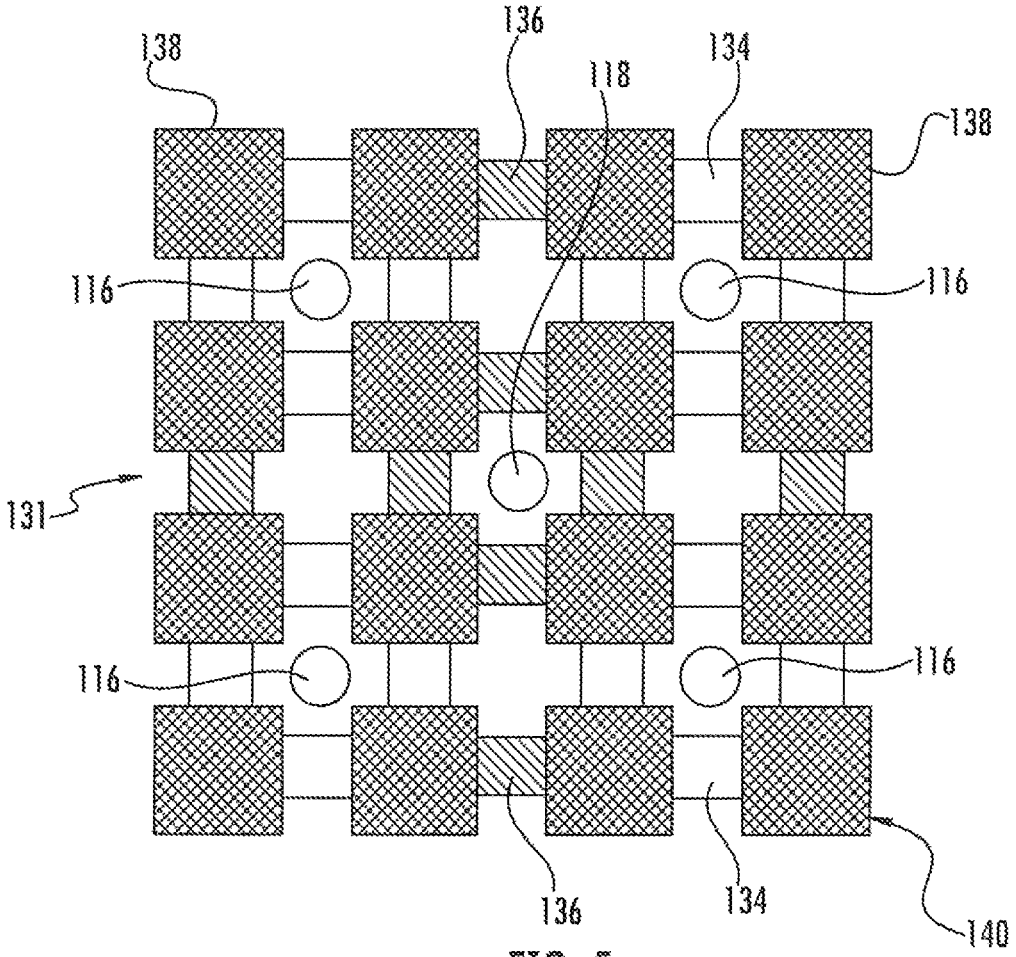
FIG. 5 is a schematic showing an optional grid pattern for an augmented cooling system according to an embodiment of the present disclosure.

Referring now to FIG. 5, a schematic of an optional grid system 140 for a cooling fluid flowpath 131 is shown. The grid system 140 includes a plurality of pedestals 138 spaced apart from one another throughout the cooling fluid flowpath 131. A plurality of inner trip strips 134 and outer trip strips 136 are positioned in predetermined locations between the pedestals 138. Each pedestal has either an inner trip strip 134 or an outer trip strip 136 extending therefrom to an adjacent pedestal 138. The pedestals 138 extend laterally between the inner wall 130 and the outer wall 132 of the dual wall component 128 (best seen in FIG. 6) to space apart the walls 130, 132 a desired distance away from one another and thus, define a space for the cooling fluid flowpath 131.

The schematic grid system 140 provides for a plurality of inlet cooling holes 118 and outlet cooling holes 116 positioned at predetermined locations between the pedestals 138. It can be seen in the disclosed embodiment that the grid system 140 can include four pedestals 138 surrounding each inlet cooling hole 118 in the inner wall 130 and each outlet cooling hole 116 in the outer wall 132. The pattern of pedestal 138 and cooling hole 116, 118 placements can be designed in a symmetric and repeatable pattern throughout the cooling fluid flowpath 131. In alternate embodiments of the grid system 140, the distance between the pedestals 138 can be varied such that the pattern is not uniform, symmetrical or repeatable across the cooling fluid flowpath 131. Further the size and shape of the pedestals 138 as well as the trip strips 134, 136 can be varied across the cooling fluid flowpath 131. By way of example and not limitation, the size, length and shape of the trip strips 134, 136 and the pedestals 138 can be varied in such a way as to permit each cooling through hole 116, 118 to substantially be surrounded by three pedestals 138. Other forms of exemplary grid systems 140 can include five or more pedestals 138 per inlet and/or outlet through hole, 118, 116 respectively. Yet another example of a grid system can include a variable number of pedestals formed about each of the cooling holes 116, 118 throughout a length of the cooling fluid flowpath 131.

Figure 6:
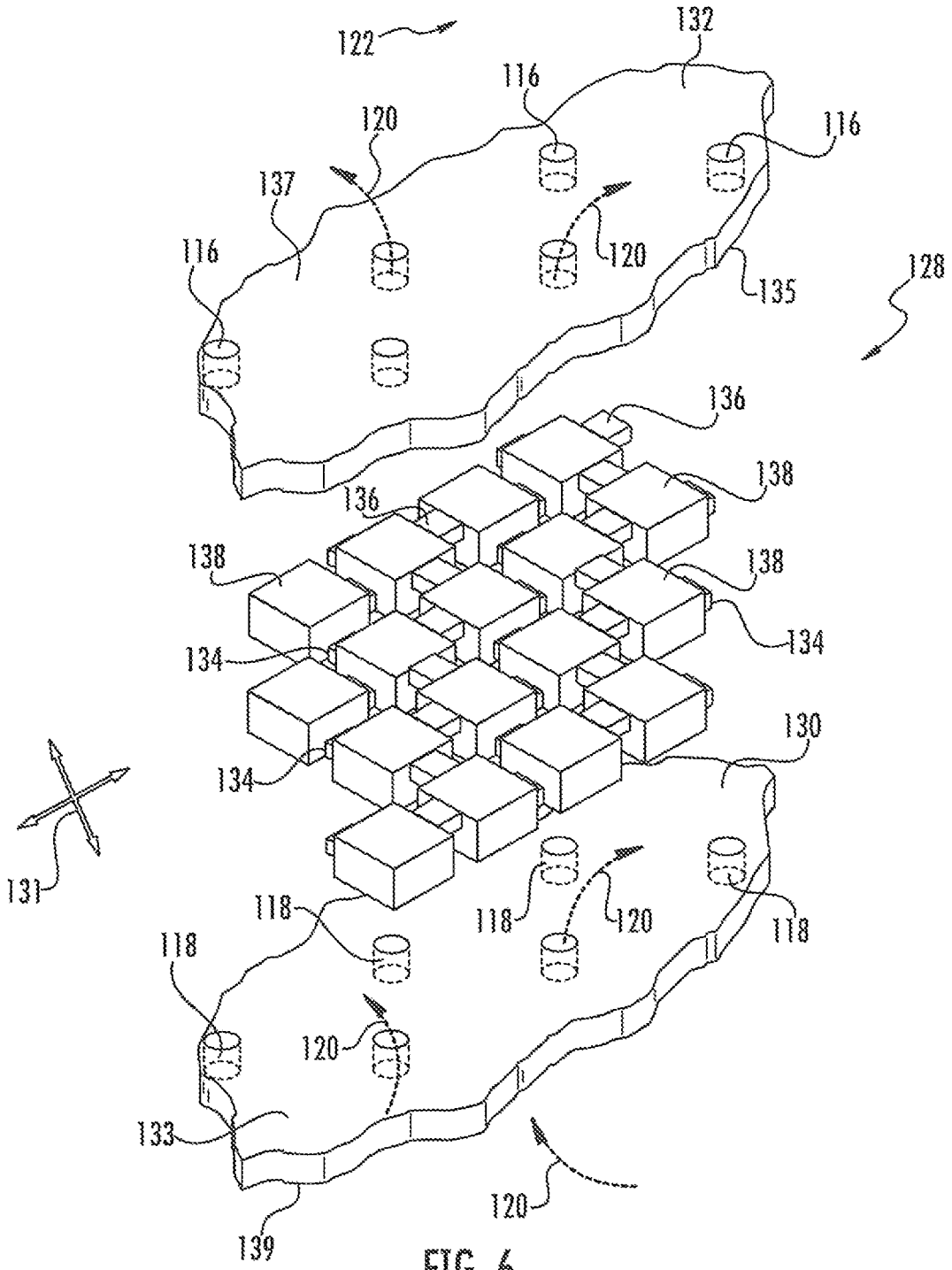
FIG. 6 is an exploded perspective view of a portion of a dual wall component according to an embodiment of the present disclosure.

Refer now to FIG. 6, a perspective exploded view of a portion of the dual wall component 128 is shown therein. A source of cooling fluid 120 can be provided to a region proximate an outer surface 139 opposite of the inner surface 133 of the inner wall 130. The cooling fluid flow 120 can enter the cooling flow passageway 131 through one or more inlet apertures 118 formed in the inner wall 130 of the dual wall component 128. After entering the cooling passageway 131, the cooling fluid 120 can traverse in any direction as portrayed by the double dual arrow 131. After entering the cooling fluid passageway 131 formed between the dual walls 130, 132, cooling fluid 120 can traverse past a plurality of inner and outer trip strips 134, 136 respectively causing an increase in flow turbulence and a change in trajectory of the cooling fluid 120 as each trip strip 134, 136 is passed. Prior to finding an exit pathway out of an outlet hole 116 in the outer wall 132 the cooling fluid 120 can traverse past at least one inner 134 trip strip and/or one outer 136 trip strip.

The cooling fluid 120 provides a heat sink for the dual wall component 128 such that heat is transferred from the walls 130, 132 to the cooling fluid 120 through convection heat transfer means as the cooling fluid 120 traverses across the cooling fluid flowpath 131. The cooling fluid 120 can also provide film cooling to the outer surface 137 of the outer wall 132 adjacent the hot flowpath 119 (best seen in FIG. 2). The film cooling can limit the heat transferred to the outer wall 132 from the hot fluid flow 122 traversing through the hot fluid flowpath 119.

The dual wall component 128 can be constructed with an inner wall 130 and an outer wall 132 spaced apart at a distance defined by the height of the pedestals 138 positioned therebetween. Each pedestal 138 can have a substantially similar height to form a cooling fluid passageway 131 that has a constant cross-sectional flow area. Alternatively, the pedestals 138 can vary in height at predetermined locations throughout the cooling fluid passageway 131 such that the cross-sectional flow area can vary along the passageway 131. The pedestals 138 and the trip strips 134, 136 can be cast in place with the inner and outer walls 130, 132 through known casting techniques or separately formed and joined through common joining processes known to those skilled in the art such as welding, hipping, brazing, or other means to permanently fix the features in place.

The augmented cooling system of the present disclosure can be implemented with any dual wall component having cooling fluid traversing between the two walls to provide cooling to a component operating in a hot environment. The dual wall component is not limited to any particular material selection, but typically if it is metal based it will include a nickel or a cobalt based alloy. Other metal alloys and/or ceramic, ceramic matrix, or metal matrix composites can also be used with the augmented cooling system of the present disclosure. Further, while the exemplary embodiments illustrated in the drawings show trip strips and pedestals with square or rectangular cross-sections, it should be understood that any desired cross-sectional shape or size of the trip strips and/or the pedestals can be used and fall under the teachings and claims of the present disclosure. By way of example and not limitation, shapes of the trip strips and pedestals can include circular, triangular, multi-angled surfaces, or even thin elongated fin type structures. The detailed design considerations will include maximizing heat transfer to the cooling fluid through conduction and convection heat transfer methods. Typically the more turbulent the cooling fluid flow becomes, the higher the convective heat transfer coefficient, however increasing the turbulence by changing the number, size and configuration of the trip strips and pedestals must include a trade off against pressure losses and flow rate reductions through the internal cooling passageway.

While the invention has been described in connection with what is presently considered to be the most practical and preferred embodiment, it is to be understood that the invention is not to be limited to the disclosed embodiment(s), but on the contrary, is intended to cover various modifications and equivalent arrangements included within the spirit and scope of the appended claims, which scope is to be accorded the broadest interpretation so as to encompass all such modifications and equivalent structures as permitted under the law. Furthermore it should be understood that while the use of the word preferable, preferably, or preferred in the description above indicates that feature so described may be more desirable, it nonetheless may not be necessary and embodiment lacking the same may be contemplated as within the scope of the invention, that scope being defined by the claims that follow. In reading the claims it is intended that the words such as "a," "an," "at least one" and "at least a portion" are used, there is no intention to limit the claim to only one item unless specifically stated to the contrary in the claim. Further, when the language "at least a portion" and/or "a portion" is used the item may include a portion and/or the entire item unless specifically stated to the contrary.

What is claimed is:

1. A cooling system comprising:

a component having an inner wall and an outer wall spaced apart from one another;

a plurality of pedestals extending between the inner and outer walls;

a plurality of inner trip strips projecting from the inner wall towards the outer wall at a predetermined height;

a plurality of outer trip strips projecting from the outer wall towards the inner wall at a predetermined height, wherein one of either the plurality of inner trip strips or the plurality of outer trip strips extends between adjacent pedestals;

at least one inlet through aperture formed in the inner wall of the component operable for transporting a cooling fluid into a space between the inner and outer walls of the component; and a plurality of outlet through apertures formed in the outer wall of the component operable for transporting the cooling fluid out of the space between the inner and the outer walls of the component;

wherein one or both of: the at least one inlet through aperture is located in an inner well bounded on all sides by a number of the plurality of the inner trip strips, and, at least one of the plurality of outlet through apertures is located in an outer well bounded on all sides by a number of the plurality of outer trip strips.

2. The cooling system of claim 1, further comprising:

a plurality of internal fluid paths formed between the at least one inlet through aperture and the outlet through apertures, each internal fluid path having at least one inner trip strip of the plurality of inner trip strips and at least one outer trip strip of the plurality of outer trip strips positioned along the path thereof.

3. The cooling system of claim 1, wherein each pedestal engages the inner wall and the outer wall of the component.

4. The cooling system of claim 1, wherein each pedestal and each trip strip is fixed to at least one of the inner wall and the outer wall of the component through one of welding, brazing or other mechanical means.

5. The cooling system of claim 1, wherein the plurality of pedestals and/or a plurality of the trip strips are formed in a casting process with at least one of the inner wall and the outer wall of the component.

6. The cooling system of claim 1, wherein the height of the inner and outer trip strips is less than a height of the pedestals.

7. The cooling system of claim 1, wherein the pedestals and trip strips have a cross sectional shape that includes at least one of a square, rectangle, triangle, circle, or other shape having a polygon exterior.

8. The cooling system of claim 1, wherein the component is located in a heat producing system.

9. The cooling system of claim 8, wherein the heat producing system is a gas turbine engine.

10. A method for cooling a dual walled component comprising:

transporting a cooling fluid through an inlet opening to a cooling pathway formed between two opposing spaced apart walls of the dual walled component;

deflecting a portion of the cooling fluid away from one wall of the cooling pathway with one of a plurality of first trip strips as the cooling fluid traverses along the cooling pathway;

deflecting a portion of the cooling fluid away from the opposing wall of the cooling pathway with one of a plurality of second trip strips as the cooling fluid continues traversing along the cooling pathway;

discharging the cooling fluid out of the cooling pathway through an outlet opening in the opposing wall of the dual walled component;

wherein at least one or both of: the transporting includes passing the cooling fluid through the inlet opening arranged within a well enclosed by a collection of the plurality of first trip strips, and, the discharging includes passing the cooling fluid through the outlet opening arranged within a well enclosed by a collection of the plurality of second trip strips.

11. The method of claim 10 further comprising:

film cooling an outer surface of one of the opposing spaced apart walls with the cooling fluid discharged from the dual walled component.

12. The method of claim 10 further comprising:

generating turbulence in the cooling fluid with each of the trip strips.

13. The method of claim 10 further comprising:

transferring heat from the dual walled component to the cooling fluid as the cooling fluid traverses through the cooling pathway; and forming the trip strips with a geometric configuration to increase heat transfer from the dual walled component into the cooling fluid.

* * * * *